United States Patent [19]

Clerk

[11] 4,116,382

[45] Sep. 26, 1978

[54] SPRAY NOZZLE FOR ATOMIZING A LIQUID BY DIRECTING IT AGAINST AN OBSTRUCTION AND HAVING IT MIX WITH AIR

[76] Inventor: Ernest Joscelyn Clerk, 18 South Ave., Rest Pen, Kingston 10, Jamaica

[21] Appl. No.: 758,498

[22] Filed: Jan. 11, 1977

[30] Foreign Application Priority Data

Jan. 26, 1976 [GB] United Kingdom ..... 2820/76

[51] Int. Cl.[2] ..... B05B 7/24

[52] U.S. Cl. ..... 239/8; 239/372; 239/373; 239/399; 239/432; 239/433

[58] Field of Search ..... 239/8, 372, 373, 390, 239/391, 399, 432, 434, 433

[56] References Cited

U.S. PATENT DOCUMENTS

| | | | |
|---|---|---|---|
| 735,287 | 8/1903 | Neuendorf | 239/399 |
| 1,901,806 | 3/1933 | Fulton | 239/432 |
| 3,251,556 | 5/1966 | Burnham | 239/432 X |

FOREIGN PATENT DOCUMENTS

| | | | |
|---|---|---|---|
| 601,877 | 7/1960 | Canada | 239/434 |

*Primary Examiner*—Bruce H. Stoner, Jr.
*Assistant Examiner*—Andres Kashnikow
*Attorney, Agent, or Firm*—Mahoney, Schick & Cislo

[57] ABSTRACT

A spray nozzle for producing a particularly fine spray of liquid and air comprises a mixing chamber for the liquid and the air, a liquid supply duct terminating within the mixing chamber in a minute, pinhole-like opening of sufficiently small dimensions to produce a fine stream of liquid at high pressure, an abutment placed in the path of the stream to cause the latter to disintegrate and to mix with the air flowing from an air supply pipe, and an outlet orifice disposed in a rotatable cap to receive the mixture from the mixing chamber. The air and liquid sources may be in a common container.

7 Claims, 2 Drawing Figures

SPRAY NOZZLE FOR ATOMIZING A LIQUID BY DIRECTING IT AGAINST AN OBSTRUCTION AND HAVING IT MIX WITH AIR

This invention relates to a method of, and apparatus for, producing a spray of liquid and gas, preferably a spray of water and air for use in, inter alia, a garden spray.

Many prior art constructions are known for producing sprays involving a method of disintegrating the liquid by causing it to issue from openings over which air is passed at some speed. In these known constructions it has either not proved possible to provide a really fine, mist-like spray of substantially uniform drop size distribution or such sprays could only be produced by cumbersome and expensive mechanical constructions.

One aim of the present invention is therefore to provide a method of, and apparatus for producing a spray of liquid and a gas which is capable of producing a very fine mist-like spray by relatively simple and inexpensive mechanical means.

According to one aspect of the present invention there is provided spray nozzle for producing a spray of liquid and a gas, comprising a mixing chamber adapted to be supplied with the gas under pressure, a liquid supply duct connectable to a source of liquid and terminating in a minute opening, such as a pin-hole, of sufficiently small dimensions to produce a jet or fine stream of liquid at high pressure, means placed in the path of said jet or stream to cause the latter to disintegrate and to mix with the gas flowing from its supply pipe, and an outlet orifice disposed to receive said mixture from the mixing chamber and adapted further to disintegrate said mixture as it issues therefrom.

According to another aspect of the invention, there is provided a method of producing a spray of liquid comprising causing said liquid to be injected into a mixing chamber through a pin-hole or the like minute opening so as to form a high-pressure jet or fine stream, directing said high-pressure jet or stream towards a solid surface in the mixing chamber to cause the liquid to disintegrate and causing a flow of pressurized air or gas to flow through said mixing chamber to mix with and assist in the disintegration of the jet or stream of liquid, and passing the mixture of liquid and gas through an outlet orifice.

Preferably, both the air duct and the liquid duct are provided with non-return valve means to prevent blow back.

In an advantageous embodiment the nozzle is displaceable relative to a body which defines therewith the said mixing chamber, the body having an inlet and at least one outlet for gas, the or each outlet being so oriented relative to the said minute opening of the liquid supply duct that in use the said fine stream or jet and the gas intersect each other.

Preferred embodiments of the invention will now be described with reference to the accompanying drawings, in which.

Figure 1:
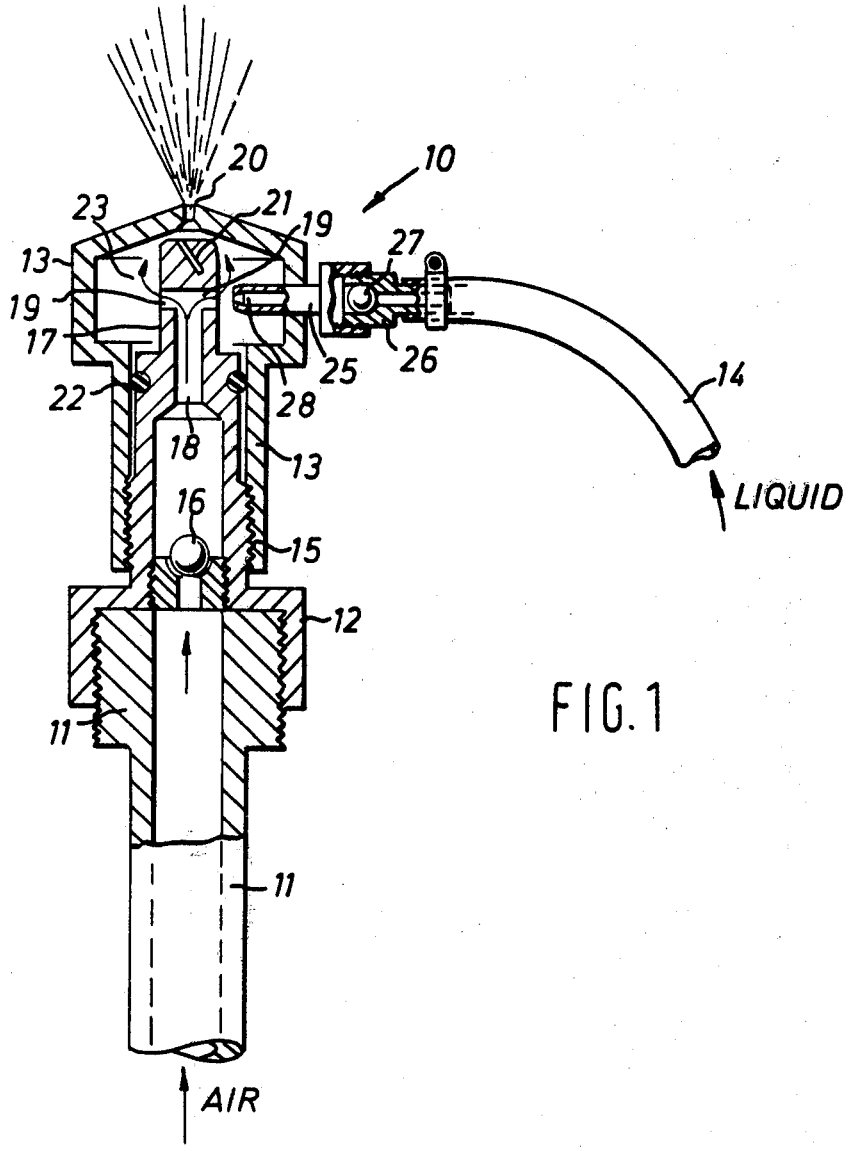
FIG. 1 is a sectional view of a spray nozzle embodied in the invention.

Referring first to FIG. 1 there is shown a spray nozzle generally indicated by the reference number 10 and comprising as its main elements an air hose 11, a body 12, a nozzle cap 13 and a liquid hose 14.

The air hose 11 is connected by screw threading to the bottom portion of the body 12 which latter is in turn screw-threadedly connected to the bottom portion of the cap 13. The body 12 has a hollow interior connected for flow communication with the interior of the air hose 11 by way of a ball valve 16 and terminates in a reduced cross-section portion 17 containing a reduced cross-section bore 18 communicating with transverse gas outlet apertures 19.

The upper end of the body 12, as viewed, is disposed closely adjacently to a small outlet orifice 20 in the cap 13 and its end face facing the orifice 20 is provided with the usual inclined slots 21 only one being shown in the drawings to impart swirl to the mixture. The body 12 is sealed yieldingly but fluid-tightly against the internal surface of the cylindrical cap 13 by way of an elastomeric O-ring 22.

The head of the cap 13 is of enlarged cross-section and its internal surface defines a mixing chamber 23 with the reduced section 17 of the body. One side of the cap 13 is provided with an aperture through which extends a duct 25 connected by a conventional coupling 26 to the liquid hose 14. A ball valve 27 is provided in the coupling 26 to prevent blow-back. The tube 25 terminates within the mixing chamber 23 in a minute opening or pin-hole 28.

The spray apparatus described so far operates as follows:

Pressurized air is first caused to flow through the hose 11 and the body 12 and issues through the transverse apertures 19 into the mixing chamber 23 and towards the outlet orifice 20. Pressurized liquid at a higher pressure then the air is then caused to flow through the hose 14 and the tube 25 where it issues through the minute opening or pin-hole 28. As a result, the liquid emerges at very high pressure from the opening 28 in the form of a jet or fine stream and is directed to hit the solid outer wall of the reduced section 17 of the body and/or to intersect the air issuing from the apertures 19 of that reduced cross-section portion 17, depending on the position of the cap 13 which, as explained below, is rotatable relative to the body 12. The liquid emerging from the opening 28 is at a higher pressure than the air in the mixing chamber 23, the dimensions of the hole being chosen so as to limit the amount of liquid entering the mixing chamber 23 to prevent the latter from filling up and from attempting to force the air down the air hose 11. As the fine stream of liquid from the opening 28 impinges on the body portion 17 and/or the air stream, it disintegrates into very fine droplets which are in turn entrained in the air stream and the mixture is given a swirling motion by slots 21 before passing to the orifice 20 where further disintegration of the liquid droplets will take place in view of the high prevailing pressures and the fineness of the aperture 20.

In view of the screw-threaded connection 15 between the body 12 and the cap 13, the cap may be displaced relative to the body to control the spray issuing from the orifice 20 by virtue of the variation of its distance from the end face of the body inside the mixing chamber 23, the O-ring acting as a seal to prevent back flow of the air and liquid past the screw threading 15.

It will be appreciated that in the nozzle of the present invention, the liquid is injected as a jet into a mixing chamber and is further disintegrated by virtue of being caused to flow through at a pin-hole or the like under very high pressure and thus does not rely on air passing over openings from which the liquid emerges to entrain the liquid.

In the FIG. 1 embodiment it may be assumed that the sources of gas and fluid supplying the hoses 11 and 14, respectively, are separate and discrete.

Figure 2:
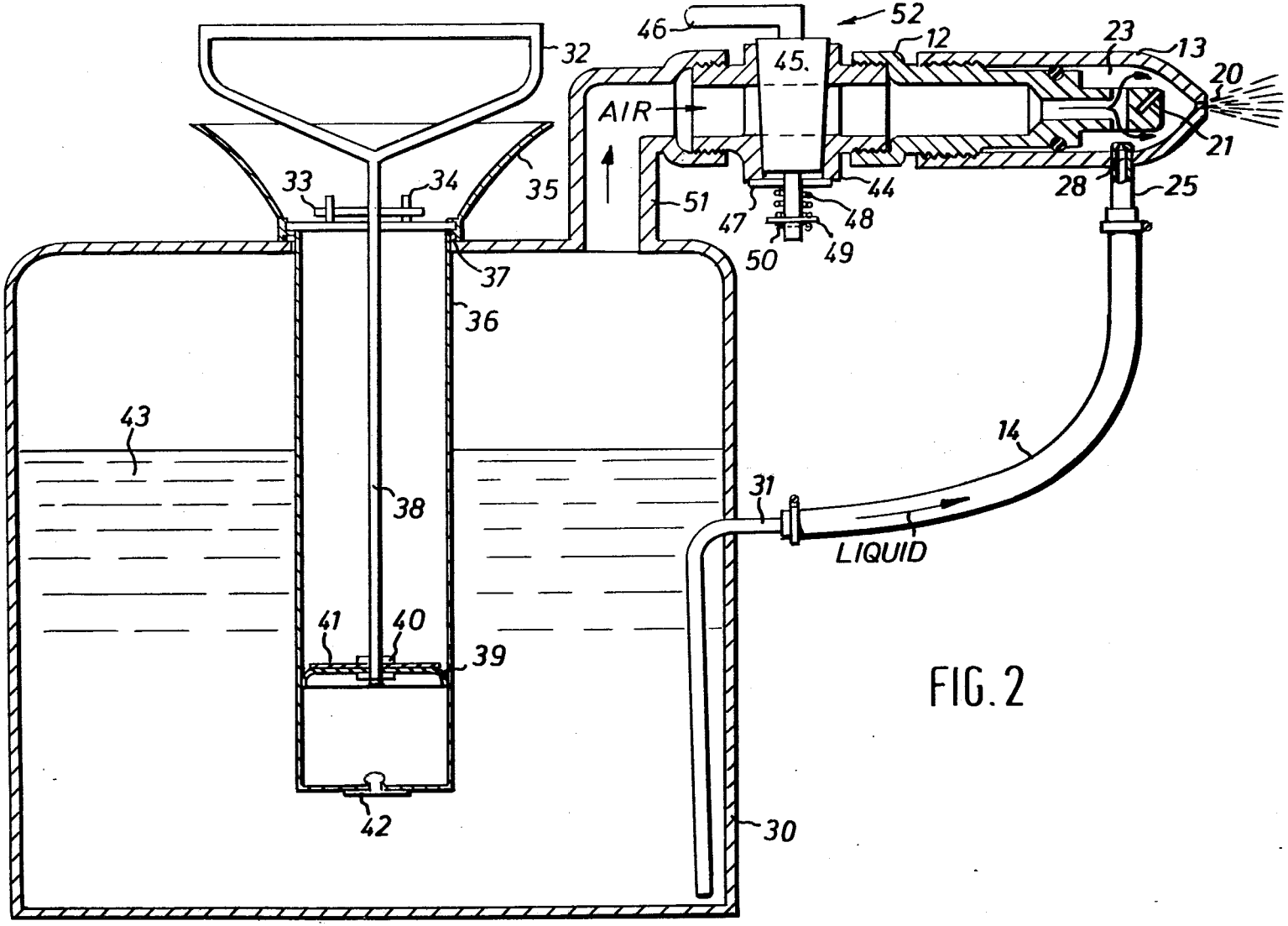
FIG. 2 is a sectional view of the nozzle of FIG. 1 secured to a container which is common both to the supply of gas and to the supply of liquid, the ball valves shown in FIG. 1 being omitted, a stop cock or valve being placed between the nozzle and the container.

FIG. 2 shows an embodiment which makes use of the spray nozzle construction shown in FIG. 1 which does not include the ball valves 16 and 28 but in which the gas and the liquid are pressurised in a common container at the same pressure, a stop cock or valve generally designated by the reference number 52, being placed between the air tube and the nozzle to control the pressure of the air reaching the nozzle.

The air hose is replaced by an air tube 51 and both it and the liquid hose 14 terminate inside a common container 30, the liquid hose 14 being connected to a dip tube 31 reaching to a position very close to the bottom of the container 30. The connection between the dip-tube 31 and the liquid hose 14 is outside the container 30 whereby to enable the liquid hose 14 to be disconnected either to adjust the spray by screwing or unscrewing the cap 13 or to replace the tube 25 by another one with a pin-hole 28 of different dimensions, it being envisaged that the tube 25 may form one member of a set of differently dimensioned tubes 25.

Although in FIG. 2 the nozzle construction is shown as rigidly connected to the container 30 this of course need not be so and the connection may be of a flexible nature.

For the remainder, the construction bears a resemblance to well-known insecticide sprayers. It comprises a handle 32 provided with a cross-member 33 co-operating with pegs 34; a funnel 35 and a pump body 36 passing into the container 30 with the intermediation of a washer 37; a pump shaft 38 integrally connected to the handle 32 and connected at its free end with a flexible, e.g. leather, washer 39 which is secured to the shaft 38 by way of nuts 40 and a backing plate 41. The bottom of the pump housing or cylinder 36 has a valve 42.

The stop cock or valve 52 is placed between the air tube 51 and the nozzle. The stop cock 52 may be of a common type comprising a body 44, an inverted truncated cone plug 45 with a lever 46, a washer 47 at the bottom of body 44, a spring 48 contained by a small washer 49 and a split pin 50. The stop cock 52 is screw-threaded into the air tube 51 which is connected to container 30. The body 12 of the nozzle is screwed on to the other end of the stop cock 45. The stop cock or valve is shown in an open position.

Liquid in the container is referred to as 43.

In operation the plug 45 is turned by the lever 46 to close the stop cock 52 and air is pumped into container 30 rising to the surface of liquid 43 where pressure is built up due to closure of the stop cock 52. The pressure of air causes liquid to be forced up the tube 31 and to issue through the pinhole 28 into the mixing chamber 23 of the nozzle, filling up chamber 23 and issuing through orifice 20 as a small stream. The stop cock 52 is then gradually opened and the pressure of the air emitting the mixing chamber 23 will force the liquid in the chamber through orifice 20. The stop cock 52 is then gradually closed to reduce the pressure of the air entering the chamber 23 to a point where the pressure of the liquid in the tube 31 is greater than the pressure of the air in the chamber 23. The liquid will then be forced through the pinhole 28 where it mixes with the air at reduced pressure entering chamber 23 the mixture issuing from the orifice as a fine mist.

If the stop cock 52 is opened too much it will prevent the liquid in tube 31 from entering chamber 23 due to the equal pressure of the air; however, the correct adjustment is quickly arrived at to provide a fine mist spray from orifice 20.

In the drawings the size of the pinholes 28 have been exaggerated for the sake of clarity but the pinhole openings envisaged are in the range of three thousandths of an inch to twenty thousandths of an inch.

I claim as my invention:

1. A method of producing a spray of liquid and air from a nozzle, comprising causing said liquid to be injected into a mixing chamber in the nozzle through a pinhole-like minute opening so as to form a high-pressure jet, directing said high-pressure jet toward an air supply pipe terminated in the mixing chamber to cause the liquid to disintegrate, causing a flow of pressurized air to flow from said air supply pipe into said mixing chamber to mix with and assist in the disintegration of the jet of liquid, passing the mixture of liquid and gas through an outlet orifice of the nozzle, the source of pressurized air and the source of liquid being in a common container in flow communication with said nozzles, the pressure of the air being used to pressurize the liquid and being adjusted so that the air passing into the nozzle is at a lower pressure than the liquid entering the nozzle.

2. A spray nozzle for producing a spray of liquid and air, comprising a supply pipe connectable to a source of pressurized air and having an outer wall with an outlet therein; a cap relatively movably connected to said supply pipe; a portion of the cap and said supply pipe defining therebetween a mixing chamber; a liquid supply duct therebetween a mixing chamber; a liquid supply duct connectable to a source of liquid, and passing through said cap so as to move relative to said supply pipe with the cap, the duct terminating within said mixing chamber adjacent the said supply pipe in a minute, pinhole-like opening so that liquid issuing therefrom is directed toward the outer wall of said supply pipe for disintegration and mixing with the air issuing from said outlet; said opening being of sufficiently small dimensions to produce a fine stream of high-pressure liquid; and a discharge orifice in said cap to receive a mixture of air and liquid from the mixing chamber, whereby a change in the relative position of the cap and the said supply pipe causes the position of said opening to vary relative to the outer wall of the said supply duct and the air outlet therein.

3. A nozzle according to claim 2 wherein there is a respective non-return valve to prevent blowback in the liquid supply duct.

4. A nozzle according to claim 2 wherein said opening is defined at the end of a tube releasably coupled to the liquid supply duct.

5. A nozzle according to claim 4 wherein said tube forms a member of a set of similar tubes of varyingly dimensioned openings.

6. A nozzle according to claim 2 wherein the source of liquid and the source of pressurised air are spaced apart, discrete physical members.

7. A spray nozzle for producing a spray of liquid and air, comprising a container, a source of pressurized air and a source of liquid within said container, a supply pipe connected to the source of pressurized air and having an outer wall with an outlet therein; a cap connected to said supply pipe; a portion of the cap and said supply pipe defining therebetween a mixing chamber; a liquid supply duct connected to the source of liquid and passing through said cap, the duct terminating within said mixing chamber adjacent the said supply pipe in a minute, pinhole-like opening so that liquid issuing therefrom is directed toward the outer wall of said supply pipe for disintegration and mixing with the air issuing from said outlet; said opening being of sufficiently small dimensions to produce a fine stream of high-pressure liquid; and a discharge orifice in said cap to receive a mixture of air and liquid from the mixing chamber.

* * * * *